US009349317B2

(12) United States Patent
Kim et al.

(10) Patent No.: US 9,349,317 B2
(45) Date of Patent: May 24, 2016

(54) ORGANIC LIGHT EMITTING DISPLAY DEVICE AND METHOD OF DRIVING THE SAME

(71) Applicant: LG DISPLAY CO., LTD., Seoul (KR)

(72) Inventors: Tae Gung Kim, Paju-si (KR); Kyeong Kun Jang, Incheon (KR); Ho Min Lim, Goyang-si (KR); Nari Kim, Hanam-si (KR); Myung-Gi Lim, Ansan-si (KR)

(73) Assignee: LG Display Co., Ltd., Seoul (KR)

( * ) Notice: Subject to any disclaimer, the term of this patent is extended or adjusted under 35 U.S.C. 154(b) by 71 days.

(21) Appl. No.: 14/056,368

(22) Filed: Oct. 17, 2013

(65) Prior Publication Data

US 2014/0176409 A1 Jun. 26, 2014

(30) Foreign Application Priority Data

Dec. 24, 2012 (KR) ..... 10-2012-0152536

(51) Int. Cl.
*G09G 3/36* (2006.01)
*G09G 3/32* (2016.01)

(52) U.S. Cl.
CPC ..... *G09G 3/3233* (2013.01); *G09G 2300/0842* (2013.01); *G09G 2320/0295* (2013.01); *G09G 2320/043* (2013.01); *G09G 2320/048* (2013.01); *G09G 2360/16* (2013.01)

(58) Field of Classification Search
CPC . G09G 3/3648; G09G 3/3659; G09G 3/3688; G09G 3/3614; G09G 2300/0842
USPC ..... 345/92
See application file for complete search history.

(56) References Cited

U.S. PATENT DOCUMENTS

2006/0279490 A1 12/2006 Park et al.
2007/0097038 A1* 5/2007 Yamazaki et al. ..... 345/76
2007/0290958 A1* 12/2007 Cok ..... 345/77
2008/0231558 A1* 9/2008 Naugler ..... 345/76

(Continued)

FOREIGN PATENT DOCUMENTS

CN 1877677 A 12/2006
CN 101373578 A 2/2009
CN 102074189 A 5/2011

OTHER PUBLICATIONS

Office Action dated Aug. 24, 2015 for corresponding Chinese Application No. 201310478586.8, 14 pages.

*Primary Examiner* — Lixi C Simpson
*Assistant Examiner* — Ngan T Pham Lu
(74) *Attorney, Agent, or Firm* — Brinks Gilson & Lione

(57) ABSTRACT

Disclosed is an organic light emitting display device and a method of driving the same that can improve compensation performance of degradation of a driving TFT. A method of driving an organic light emitting display device comprises generating an estimated degradation value of a driving TFT by using accumulated data through input data counting; compensating all the pixels of a display panel by using a first gain value, which is initially set, and the estimated degradation value; generating a sensing value by sensing all or some of the pixels of the display panel after driving is performed for a certain time; generating a second gain value by compensating the first gain value if an error between the estimated degradation value and the sensing value is more than a reference value; generating compensation data by compensating the estimated degradation value by using the second gain value; and compensating all the pixels of the display panel by using the compensation data.

11 Claims, 9 Drawing Sheets

(56) References Cited

U.S. PATENT DOCUMENTS

2009/0051628 A1 2/2009 Kwon
2009/0174628 A1 7/2009 Wang et al.
2010/0073335 A1 3/2010 Min et al.
2011/0122119 A1 5/2011 Bae et al.

* cited by examiner sensed_Vth = sensing data − ref data (initial Vth)
counted_Vth = counting data − ref data
Gain ' = gain × sensed_Vth / counted_Vth

ORGANIC LIGHT EMITTING DISPLAY DEVICE AND METHOD OF DRIVING THE SAME

CROSS REFERENCE TO RELATED APPLICATIONS

This application claims the benefit of priority to Korean Patent Application No. 10-2012-0152536 filed on Dec. 24, 2012, which is hereby incorporated by reference as if fully set forth herein.

BACKGROUND

1. Field of the Disclosure

Embodiments of the present disclosure relate to an organic light emitting display device, and more particularly, to an organic light emitting display device which facilitates to improve an efficiency in compensating degradation of a driving TFT, and a method of driving the same.

2. Discussion of the Related Art

FIG. 1 is a circuit diagram illustrating a pixel of an organic light emitting display device according to the related art.

Referring to FIG. 1, each pixel of a display panel may include a first switching TFT (ST1), a second switching TFT (ST2), a driving TFT (DT), a capacitor (Cst), and an organic light emitting diode (OLED).

The first switching TFT (ST1) is switched by a scan signal (or gate signal) supplied to a gate line GL. According as the first switching TFT (ST1) is turned-on, a data voltage (Vdata) supplied to a data line (DL) is supplied to the driving TFT (DT).

The driving TFT (DT) is switched by the data voltage (Vdata) supplied from the first switching TFT (ST1). A data current (Ioled) flowing to the organic light emitting diode (OLED) is controlled by switching the driving TFT (DT).

The capacitor (Cst) is connected between gate and source terminals of the driving TFT (DT), wherein the capacitor (Cst) stores a voltage corresponding to the data voltage (Vdata) supplied to the gate terminal of the driving TFT (DT), and turns-on the driving TFT (DT) by the use of stored voltage.

The organic light emitting diode (OLED) is electrically connected between a cathode power source (VSS) and the source terminal of the driving TFT (DT), wherein the organic light emitting diode (OLED) emits light in response to the data current (Ioled) supplied from the driving TFT (DT).

The organic light emitting display device according to the related art controls an intensity of the data current (Ioled) flowing from the first driving power (VDD) to the organic light emitting diode (OLED) by switching the driving TFT (DT) according to the data voltage (Vdata), whereby the organic light emitting diode (OLED) emits light, thereby displaying an image.

However, in case of the organic light emitting display device according to the related art, the characteristics of driving TFT (DT), for example, threshold voltage (Vth) and mobility may be differently shown by each pixel due to ununiformity in a process of manufacturing the TFT. Accordingly, even though the data voltage (Vdata) is identically applied to the driving TFT (DT) for each pixel, it is difficult to realize uniform picture quality due to a deviation of the current flowing in the organic light emitting diode (OLED).

If video data (data voltage) is applied to the driving TFT (DT) for a long time, the threshold voltage (Vth) of the driving TFT (DT) is shifted due to stress. In order to compensate for the shift of the threshold voltage (Vth) of the driving TFT (DT), there are an internal compensation method and an external compensation method. In case of the internal compensation method, a compensation process is performed inside the pixel. Meanwhile, in case of the external compensation method, a compensation process is performed outside the pixel.

For the external compensation, a sensing signal line (SL) is formed in the same direction as a gate line (GL). The second switching TFT (ST2) is switched by a sensing signal (sense) applied to the sensing signal line (SL). The data current (Ioled), which is supplied to the organic light emitting diode (OLED) by the switching of the second switching TFT (ST2), is sensed by an ADC (analog-to-digital converter) of a drive IC.

In case of the external compensation, the threshold voltage (Vth)/mobility of the driving TFT (DT) may be sensed after blocking the current flowing in the organic light emitting diode (OLED). Then, sensing data may be generated by the sensing driving, and variations in the characteristics of driving TFT (DT) may be compensated based on the sensing data.

However, in case of the related art sensing compensation method, the driving TFT (DT) is sensed under the condition that there is no current flowing in the organic light emitting diode (OLED) by blocking the first driving power (VDD). Thus, when an image is displayed, it is difficult to apply the related art sensing compensation method.

In order to overcome this problem, the sensing signal is supplied to one horizontal line among all horizontal lines during a blank period (if it is driven by 120 Hz, about 360 us) between an (n)th frame and an (n+1)th frame, thereby performing a real-time sensing process.

During the blank periods of the plurality of frames, the pixels are sequentially sensed by each one horizontal line from the first horizontal line to the last horizontal line, thereby sensing the threshold voltage (Vth)/mobility of the driving TFT (DT) for all the pixels. After that, compensation data is generated based on the sensed threshold voltage (Vth)/mobility, and then data voltage (Vdata) applied to the pixel is compensated based on the generated compensation data.

However, in case of the related art real-time sensing method, it is difficult to obtain precise sensing data since it is very sensitive to the surroundings such as light or temperature. Also, during the sensing process, the current is not flowing in the pixel, whereby a luminance of the line performed with the sensing process is relatively decreased by 5% in comparison to that of the lines normally supplied with the current. Thus, the sensing line on a screen is discerned due to the relatively-low luminance by the sensing driving.

In order to overcome this problem, stress data of the driving TFT (DT) is accumulated by counting the video data, to thereby estimate a degradation level of the driving TFT (DT). Then, the compensation data is generated based on the estimated degradation level, and the external compensation is performed. That is, the compensation data may be generated by accumulating the stress data of the driving TFT (DT) without sensing the pixel.

FIG. 2 illustrates problems of degradation compensating method using the data counting method according to the related art.

Referring to FIG. 2, the degradation compensating method using the data counting method has the following problems. If a degradation modeling of the driving TFT (DT) is not precise, there may be errors in the compensation data. Even though the degradation modeling is precise, a counting value of the video is distorted if an image is displayed for a long time, and the distorted counting value of the video data is gradually increased in accordance with the elapse of time.

Thus, if the error of the counting value of the video data is not compensated, errors occur in the compensation data.

SUMMARY

A method of driving an organic light emitting display device, which comprises generating an estimated degradation value of a driving TFT by using accumulated data through input data counting; compensating all the pixels of a display panel by using a first gain value, which is initially set, and the estimated degradation value; generating a sensing value by sensing all or some of the pixels of the display panel after driving is performed for a certain time; generating a second gain value by compensating the first gain value if an error between the estimated degradation value and the sensing value is more than a reference value; generating compensation data by compensating the estimated degradation value by using the second gain value; and compensating all the pixels of the display panel by using the compensation data.

In another aspect of the present invention, an organic light emitting display device comprises a display panel on which a plurality of pixels are arranged; a gate driver supplying a scan signal and a sensing signal to the plurality of pixels; a data driver supplying a compensated data voltage to the plurality of pixels and sensing characteristics of the plurality of pixels; and a timing controller driving the gate driver and the data driver in a driving mode and a sensing mode and generating compensation data by using an estimated degradation value of a driving TFT based on accumulated data through input data counting and a sensing value obtained by sensing of the plurality of pixels.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

On explanation about the embodiments of the present invention, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, a method of driving an organic light emitting display device according to embodiments of the present invention will be described in detail with reference to the accompanying drawings. Herein, the present invention relates to a method of driving an organic light emitting display device using an external compensation method.

Figure 1:
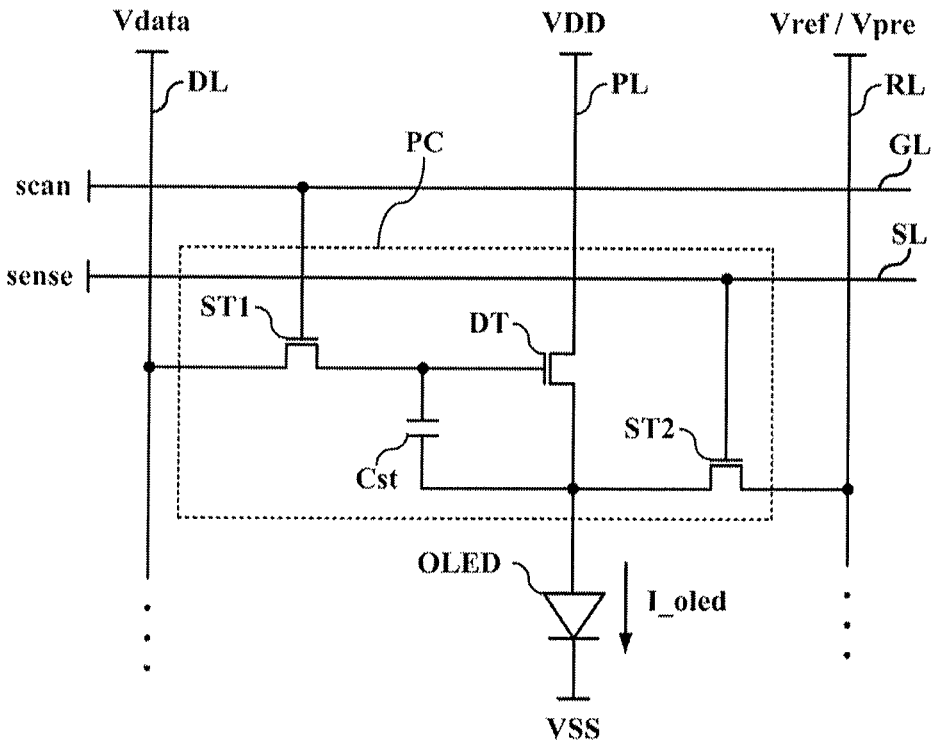
FIG. 1 Related Art
FIG. 1 is a circuit diagram illustrating a pixel of an organic light emitting display device according to the related art.
Figure 2:
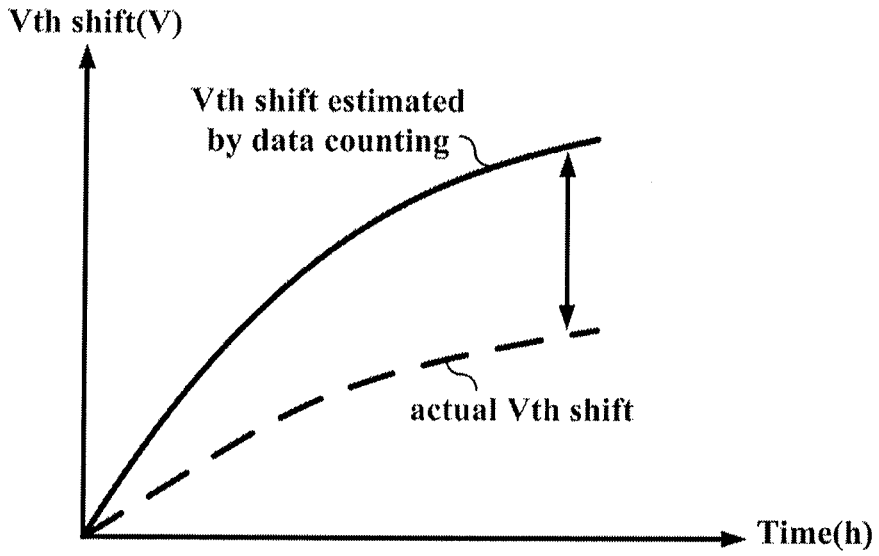
FIG. 2 Related Art
FIG. 2 illustrates problems of degradation compensating method using a data counting method according to the related art.
Figure 3:
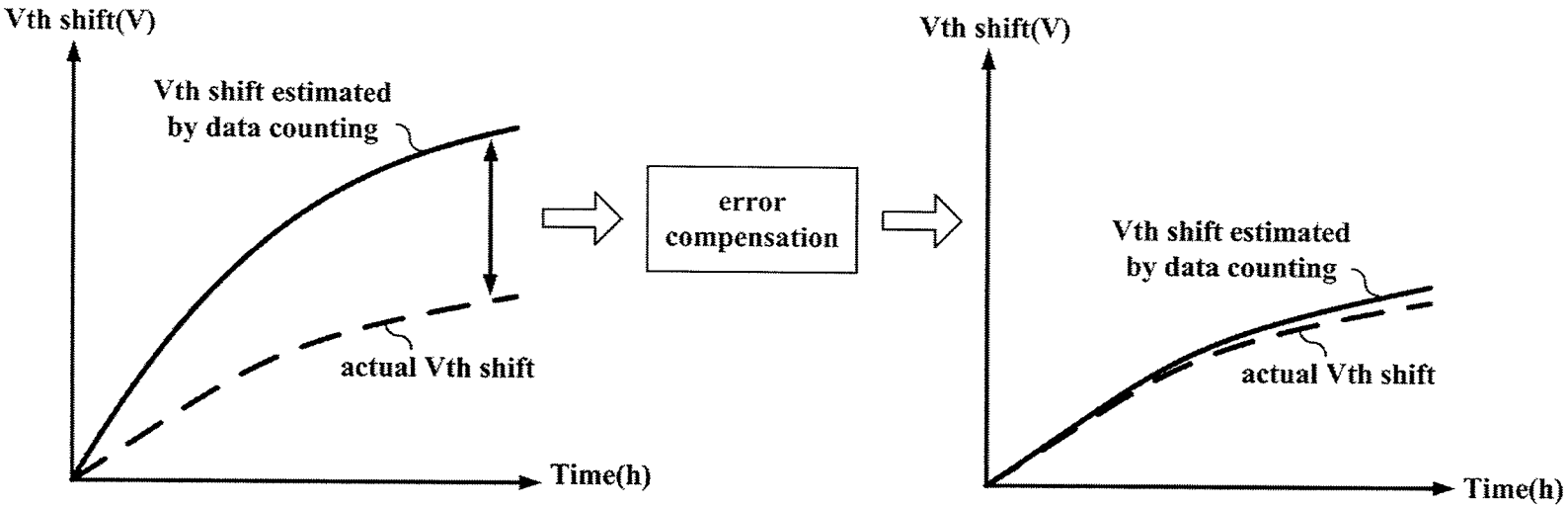
FIG. 3 illustrates a method of driving an organic light emitting display device according to the embodiment of the present invention, which relates to a degradation compensating method through combination of a data counting method and a sensing method.

FIG. 3 illustrates a method of driving an organic light emitting display device according to the embodiment of the present invention, which relates to a degradation compensating method obtained by mixing both a sensing method and a data counting method.

Referring to FIG. 3, when a thin film transistor (TFT) of a pixel circuit is stressed according to video data, a threshold voltage (Vth) is shifted to a negative or positive direction. In order to overcome this problem, a data counting method is used to estimate a degradation level of driving TFT, and to perform a compensation process based on an estimated value.

However, even though the degradation of driving TFT is compensated by the data counting method, a difference between the estimated degradation value of the driving TFT, which is estimated by the data counting method, and an actual degradation value may be gradually increased in accordance with the elapse of time, thereby causing an error.

In order to overcome this problem, a method of driving the organic light emitting display device according to the present invent compares an estimation value for estimating degradation of driving TFT by the use of data counting method, that is, a shift estimation value of threshold voltage, with a threshold voltage sensing value of driving TFT, which is actually obtained by sensing a pixel; and compensating for an error if there is a difference between the above two values.

The shift estimation value of threshold voltage in the driving TFT, estimated by the data counting method, is matched to the actual sensing value of driving TFT, which is obtained by actually sensing the pixel. Based on the matching between the shift estimation value of threshold voltage in the driving TFT and the actual sensing value of driving TFT, a gain value applied to generate compensation data is compensated by the use of accumulation data obtained in the data counting method. Accordingly, the degradation of driving TFT is compensated by the data counting method, and the precise compensation value is applied thereto.

Figure 4:
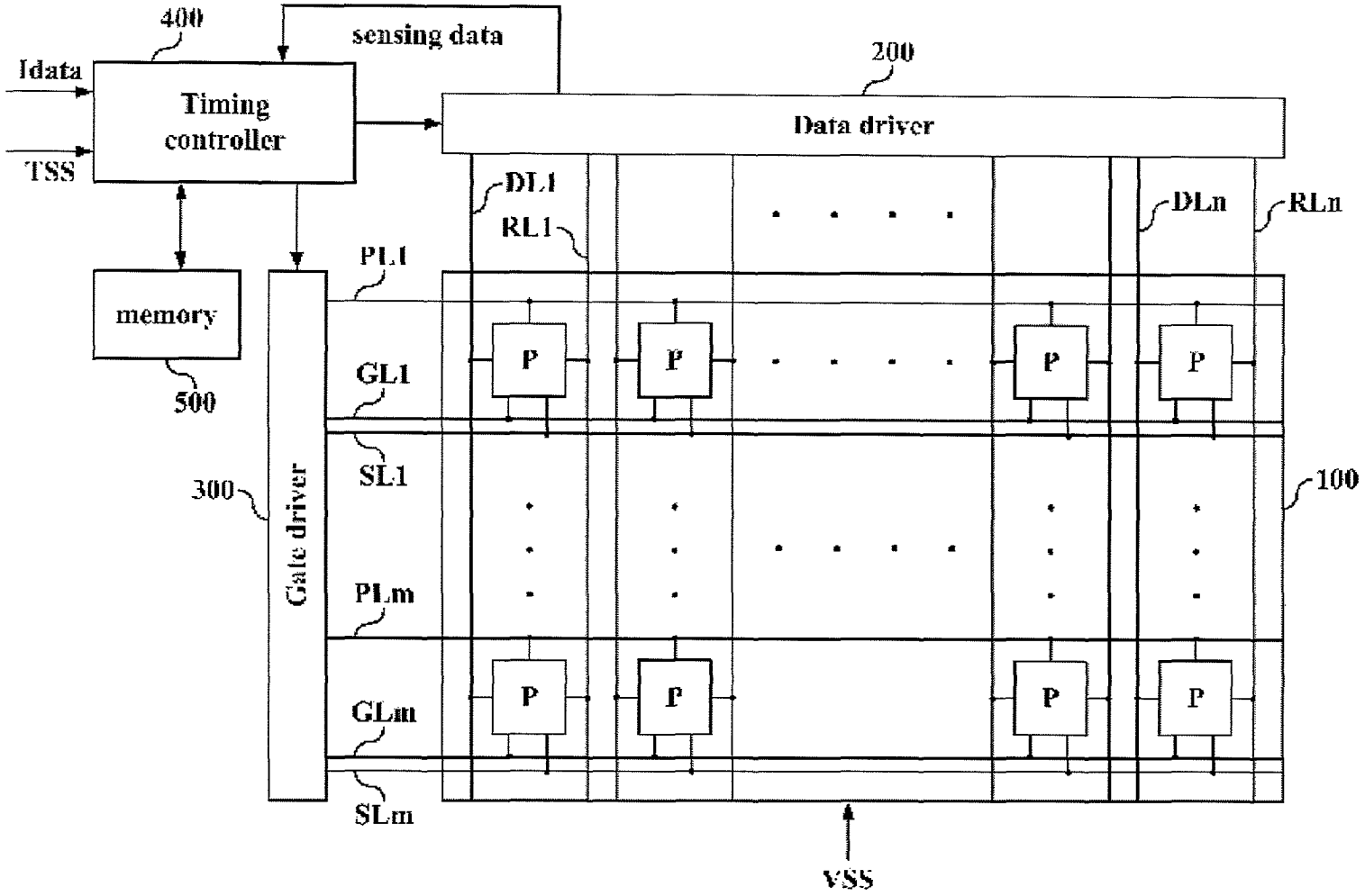
FIG. 4 illustrates an organic light emitting display device according to the embodiment of the present invention.
Figure 5:
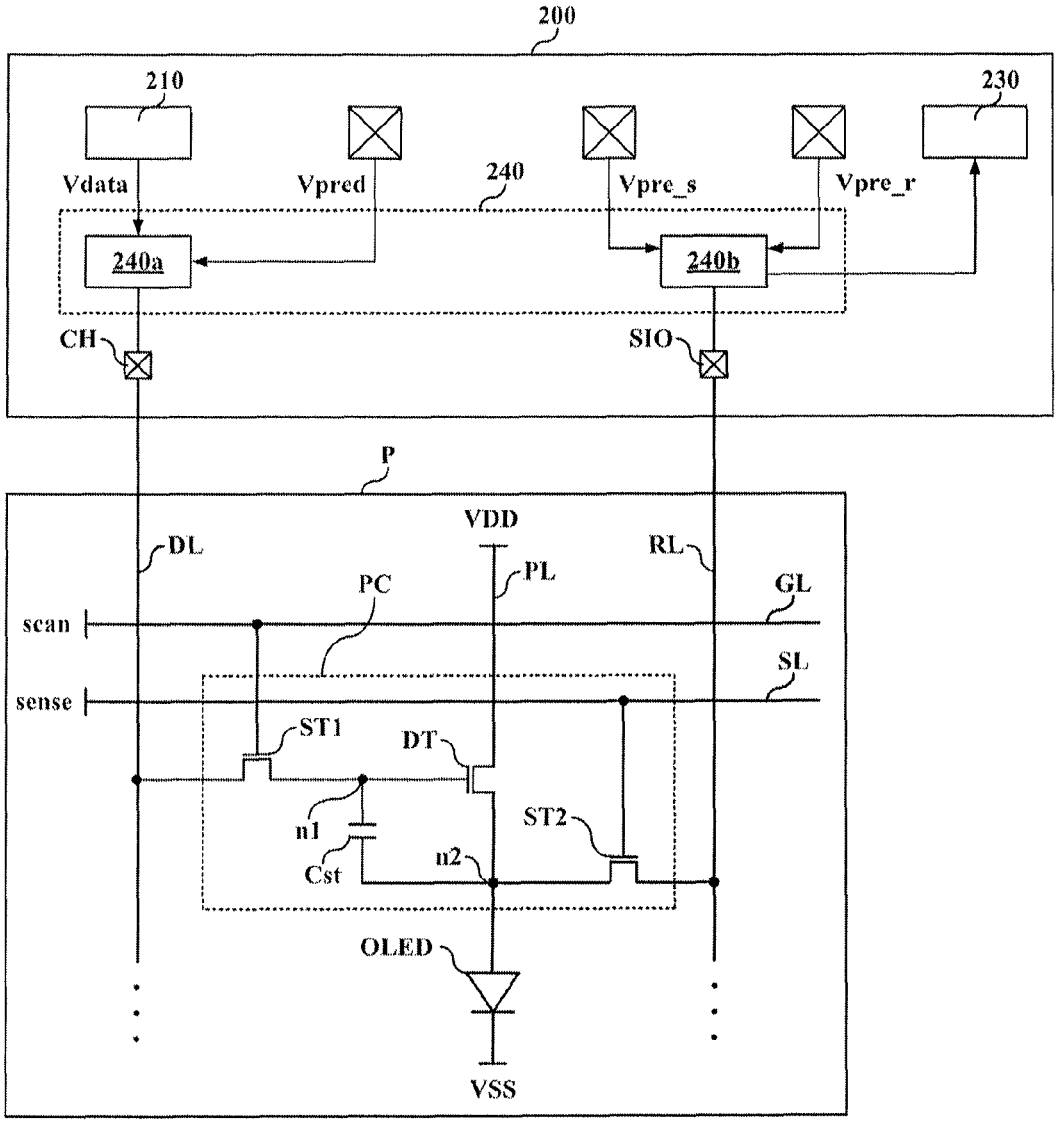
FIG. 5 illustrates a data driver, a pixel structure and a sensing method in the organic light emitting display device according to the embodiment of the present invention.

FIG. 4 illustrates an organic light emitting display device according to the embodiment of the present invention. FIG. 5 illustrates a data driver, a pixel structure and a sensing method in the organic light emitting display device according to the embodiment of the present invention.

Referring to FIGS. 4 and 5, the organic light emitting display device according to the embodiment of the present invention may include a display panel 100 and a panel driver. The panel driver 100 may include a data driver 200, a gate driver 300, a timing controller 400, and an initial compensation memory 500 for storing initial compensation data therein.

After manufacturing a display panel, the initial compensation data is stored in the initial compensation memory 500 before a shipment of product. The initial compensation data is generated based on sensing data generated by sensing the driving TFT for all the pixels before a shipment of product. The initial compensation data is stored in the initial compensation memory 500 in order to compensate for the characteristics of driving TFT of all the pixels. The initial compensation for all the pixels is performed through the use of initial compensation data stored in the initial compensation memory 500 before a shipment of product.

The display panel 100 may include a plurality of gate lines (GL), a plurality of sensing signal lines (SL), a plurality of data lines (DL), a plurality of driving power lines (PL), a plurality of reference voltage lines (RL), and a plurality of pixels (P).

Each of the pixels (P) may include an organic light emitting diode (OLED), and a pixel circuit (PC) for driving the organic light emitting diode (OLED) so as to make the organic light emitting diode (OLED) emit light.

A capacitor (Cst) connected between gate and source electrodes of the driving TFT (DT) is charged with a differential voltage (Vdata−Vref) between a data voltage (Vdata) and a reference voltage (Vref). The driving TFT (DT) is switched according to the charging voltage of the capacitor (Cst). The organic light emitting diode (OLED) emits light in response to the data current (Ioled) flowing from a first driving power (VDD) to a second driving power (VSS) through the driving TFT (DT).

Each of the pixels (P) may be any one among red, green, blue and white pixels. A unit pixel for displaying an image may comprise adjacent red, green and blue pixels. According to another example, a unit pixel for displaying an image may comprise adjacent red, green, blue and white pixels.

Each of the pixels (P) is formed in a pixel region defined on the display panel 100. On the display panel 100, there are the plurality of gate lines (GL), the plurality of sensing signal lines (SL), the plurality of data lines (DL), the plurality of driving power lines (PL) and the plurality of reference voltage lines (RL) so as to define the pixel region.

The plurality of gate lines (GL) and the plurality of sensing signal lines (SL) may be formed in a first direction (for example, horizontal direction) of the display panel 100. In this case, a scan signal (scan, gate driving signal) is applied from the gate driver 300 to the gate line (GL), and a sensing signal is applied from the gate driver 300 to the sensing signal line (SL).

The plurality of data lines (DL) are formed in a second direction (for example, vertical direction) of the display panel 100, that is, the plurality of data lines (DL) are provided to cross the plurality of gate lines (GL) and the plurality of sensing signal lines (SL). In this case, a data voltage (Vdata) is supplied from the data driver 200 of the panel driver to the data line (DL). The data voltage (Vdata) has a level of voltage obtained by adding a voltage of source data and a compensation voltage corresponding to the shift of the threshold voltage (Vth) in the driving TFT (DT) of the corresponding pixel (P). The compensation voltage will be described later.

The plurality of reference voltage lines (RL) are respectively provided in parallel to the plurality of data lines (DL). The reference voltage line (RL) may be selectively supplied with a display reference voltage (Vrep_r) or a sensing pre-charging voltage (Vpre_s) from the data driver 200.

In this case, the display reference voltage (Vrep_r) may be supplied to each reference voltage line (RL) during a data charging period for each pixel (P). The sensing pre-charging voltage (Vpre_s) may be supplied to the reference voltage line (RL) during a sensing period for sensing threshold voltage/mobility of the driving TFT (DT) for each pixel (P).

The plurality of driving power lines (PL) may be respectively formed in parallel to the gate lines (GL). The first driving power (VDD) is supplied to the pixel (P) through the driving power line (P1).

The pixel circuit (PC) for each pixel (P) may include a first switching TFT (ST1), a second switching TFT (ST2), the driving TFT (DT) and the capacitor (Cst). In this case, the TFTs ST1, ST2 and DT may be N-type TFTs, for example, a-Si TFT, poly-Si TFT, oxide TFT, organic TFT, and etc., but not limited to these. Instead, the TFTs ST1, ST2 and DT may be P-type TFTs.

The first switching TFT (ST1) may include a gate electrode connected to the gate line (GL), a source electrode (first electrode) connected to the data line (DL), and a drain electrode (second electrode) connected to a first node (n1) connected to the gate electrode of the driving TFT (DT).

The first switching TFT (ST1) is turned-on by the scan signal of a gate-on voltage level supplied to the gate line (GL). If the first switching TFT (ST1) is turned-on, the data voltage (Vdata) supplied to the data line (DL) is supplied to the first node (n1), that is, the gate electrode of the driving TFT (DT).

The second switching TFT (ST2) may include a gate electrode connected to the sensing signal line (SL), a source electrode (first electrode) connected to the reference voltage line (RL), and a drain electrode (second electrode) connected to a second node (n2) connected to the driving TFT (DT) and the organic light emitting diode (OLED).

The second switching TFT (ST2) is turned-on by the sensing signal of a gate-on voltage level supplied to the sensing signal line (SL). If the second switching TFT (ST2) is turned-on, the sensing pre-charging voltage (Vpre_s) or the display reference voltage (Vpre_r), which is supplied to the reference voltage line (RL), is supplied to the second node (n2).

The capacitor (Cst) is connected between the gate and source electrodes of the driving TFT (DT). The first electrode of the capacitor (Cst) is connected to the first node (n1), and the second electrode of the capacitor (Cst) is connected to the second node (n2). In this case, the differential voltage between the voltages respectively supplied to the first and second nodes (n1) and (n2) is charged in the capacitor (Cst).

Then, the driving TFT (DT) is switched by the voltage charged in the capacitor (Cst).

The gate electrode of the driving TFT (DT) is connected to the drain electrode of the first switching TFT (ST1) and the first electrode of the capacitor (Cst) in common. Also, the drain electrode of the driving TFT (DT) is connected to the driving power line (PL). The source electrode of the driving TFT (DT) is connected to the drain electrode of the second switching TFT (ST2), the second electrode of the capacitor (Cst), and an anode of the organic light emitting diode (OLED) in common.

As the driving TFT (DT) is turned-on by the voltage of the capacitor (Cst) every light emitting period, an amount of current flowing to the organic light emitting diode (OLED) is controlled by the first driving power (VDD).

The organic light emitting diode (OLED) is driven by the data current (Ioled) supplied from the driving TFT (DT) of the pixel circuit (PC), to thereby emit monochromatic light with a luminance corresponding to the data current (Ioled).

To this end, the organic light emitting diode (OLED) may include an anode electrode (not shown) which is connected to the second node (n2) of the pixel circuit (PC), an organic layer (not shown) which is formed on the anode electrode, and a cathode electrode (not shown) which is supplied with the second driving power (VSS) and formed on the organic layer.

In this case, the organic layer may be formed in a deposition structure of hole transport layer/organic light emitting layer/electron transport layer or a deposition structure of hole injection layer/hole transport layer/organic light emitting layer/electron transport layer/electron injection layer. Furthermore, the organic layer may include a functional layer for improving light-emitting efficiency and/or lifespan of the organic light emitting layer. Also, the second driving power (VSS) may be supplied to the cathode electrode of the organic light emitting diode (OLED) through a second driving power line (not shown) formed in a line shape.

The gate driver 300 may be operated in a driving mode (display mode) or a sensing mode according to a mode control of the timing controller 400. The gate driver 300 is connected to the plurality of gate lines (GL) and the plurality of sensing signal lines (SL).

In case of the driving mode, the gate driver 300 generates a scan signal (scan) of gate-on voltage level every one horizontal period according to a gate control signal (GCS) supplied from the timing controller 400, and then sequentially supplies the generated scan signal (scan) to the plurality of gate lines (GL).

While the scan signal (scan) has a gate-on voltage level during the data charging period for each pixel (P), the scan signal (scan) has a gate-off voltage level during the light emitting period for each pixel (P). The gate driver 300 may be a shift register for sequentially outputting the scan signal (scan).

In case of the sensing mode, the gate driver 300 generates the sensing signal (sense) of gate-on voltage level every initialization period and sensing voltage charging period for each pixel (P), and then sequentially supplies the generated sensing signal (sense) to the plurality of sensing signal lines (SL).

For example, in case of the sensing mode, the sensing of pixel is sequentially performed every one horizontal line. In case of the sensing mode, the gate driver 300 sequentially supplies the sensing signal to the entire horizontal lines from the uppermost line to the lowermost horizontal line, whereby the entire horizontal lines are sequentially sensed in order from the uppermost line to the lowermost line.

The gate driver 300 may be formed in an integrated circuit (IC) type, or may be directly formed on a substrate of the display panel 100 during a process of manufacturing the transistor for each pixel (P).

The gate driver 300 is connected to the plurality of driving power lines (PL1 to PLm), and the gate driver 300 supplies the driving power (VDD), supplied from an external power supplier (not shown), to the plurality of driving power lines (PL1 to PLm).

As shown in FIG. 5, the data driver 200 is connected to the plurality of data lines (D1 to Dn), whereby the data driver 200 is operated in the display mode or sensing mode according to the mode control of the timing controller 400.

The driving mode for displaying an image may be driven to have the data charging period for charging each pixel with the data voltage, and the light emitting period for operating the organic light emitting diode (OLED). Also, the sensing mode may be driven to have in the initialization period for initializing each pixel, the sensing voltage charging period, and the sensing period.

The data driver 200 may include a data voltage generator 210, a sensing data generator 230, and a switch 240. The data driver 200 is connected to the plurality of data lines (D1 to Dn), wherein the data driver 200 is operated in the display mode or sensing mode according to the mode control of the timing controller 400.

The data voltage generator 210 converts the input pixel data into the data voltage (Vdata), and supplies the data voltage (Vdata) to the data line (DL). To this end, the data voltage generator 210 may include a shift register, a latch, a grayscale voltage generator, a digital-to-analog converter (DAC), and an output part.

The shift register generates a sampling signal, and the latch latches the pixel data (DATA) according to the sampling signal. The grayscale voltage generator generates a plurality of grayscale voltages by the use of reference gamma voltages, and the digital-to-analog converter (DAC) selects the grayscale voltage corresponding to the latched pixel data (DATA) among the plurality of grayscale voltages, and outputs the selected grayscale voltage as the data voltage (Vdata). Then, the output part outputs the data voltage (Vdata) to the data line (DL).

The switch 240 may include a plurality of first switches 240*a* and a plurality of second switches 240*b*.

In the driving mode, the plurality of first switches 240*a* switch the data voltage (Vdata) or reference voltage (Vpre_d), and then supply the switched data voltage (Vdata) or reference voltage (Vpre_d) to the data line (DL).

In the sensing mode, the plurality of second switches 240*b* switch the display reference voltage (Vpre_r) or sensing pre-charging voltage (Vpre_s), and then supply the switched display reference voltage (Vpre_r) or sensing pre-charging voltage (Vpre_s) to the reference voltage line (RL). After floating the reference voltage line (RL) supplied with the sensing pre-charging voltage (Vpre_s) through the use of second switch 240*b*, the floating reference voltage line (RL) is connected to the sensing data generator 230, thereby sensing the corresponding pixel.

For example, in the driving mode for displaying an image, an image is displayed by supplying the data voltage (Vdata) according to the video data to the data lines (DL) in order from the first data line to the last data line for a time period of N frame. In this case, the reference voltage line (RL) is supplied with the display reference voltage (Vpre_r).

The plurality of second switches 240*b* are switched during the blank period between the (n)th frame and the (n+1)th frame, whereby the sensing pre-charging voltage (Vpre_s) is supplied to one reference voltage line (SL) or the plurality of reference voltage lines (RL). For example, the sensing pre-charging voltage (Vpre_s) may be about 1V.

After floating the reference voltage line (RL) through the second switch 240*b*, the reference voltage line (RL) is connected to the sensing data generator 230, thereby sensing the corresponding pixel.

The sensing data generator 230 senses the voltage charged in the reference voltage line (RL), generates sensing data of digital type corresponding to the sensed analog voltage, and provides the generated sensing data to the timing controller 400.

In this case, the voltage sensed by the reference voltage line (RL) may be determined by a ratio of the current flowing in the driving TFT (DT) in accordance with a change of time to a capacitance of the reference voltage line (RL). In this case, the sensing data may be the data corresponding to the threshold voltage/mobility of the driving TFT (DT) for each pixel (P).

Figure 6:
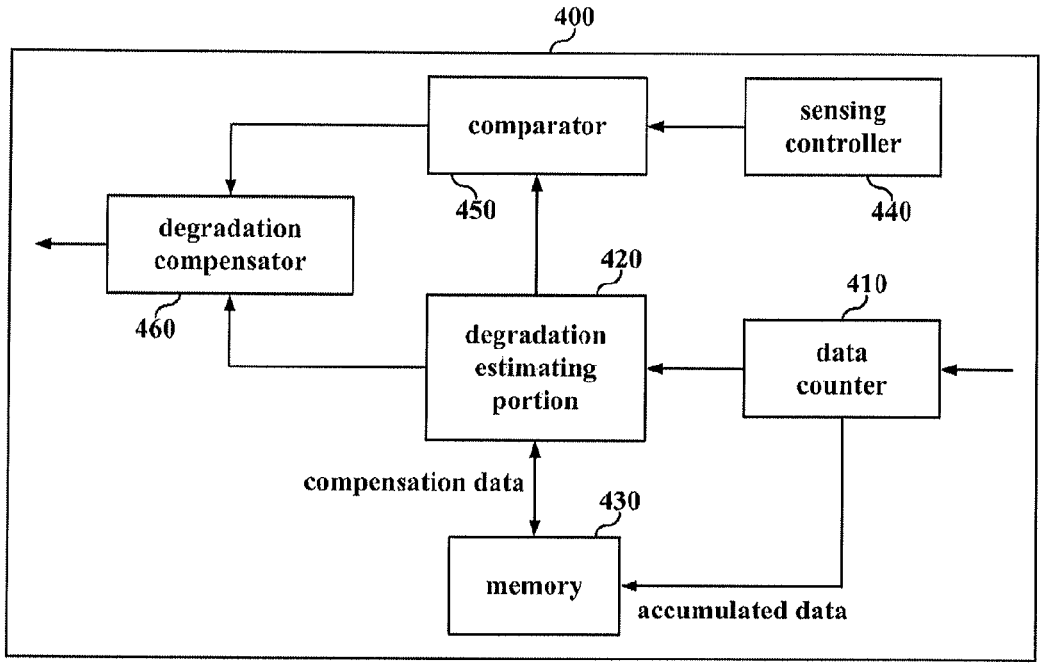
FIG. 6 illustrates a timing controller of the organic light emitting display device according to the embodiment of the present invention.
Figure 7:
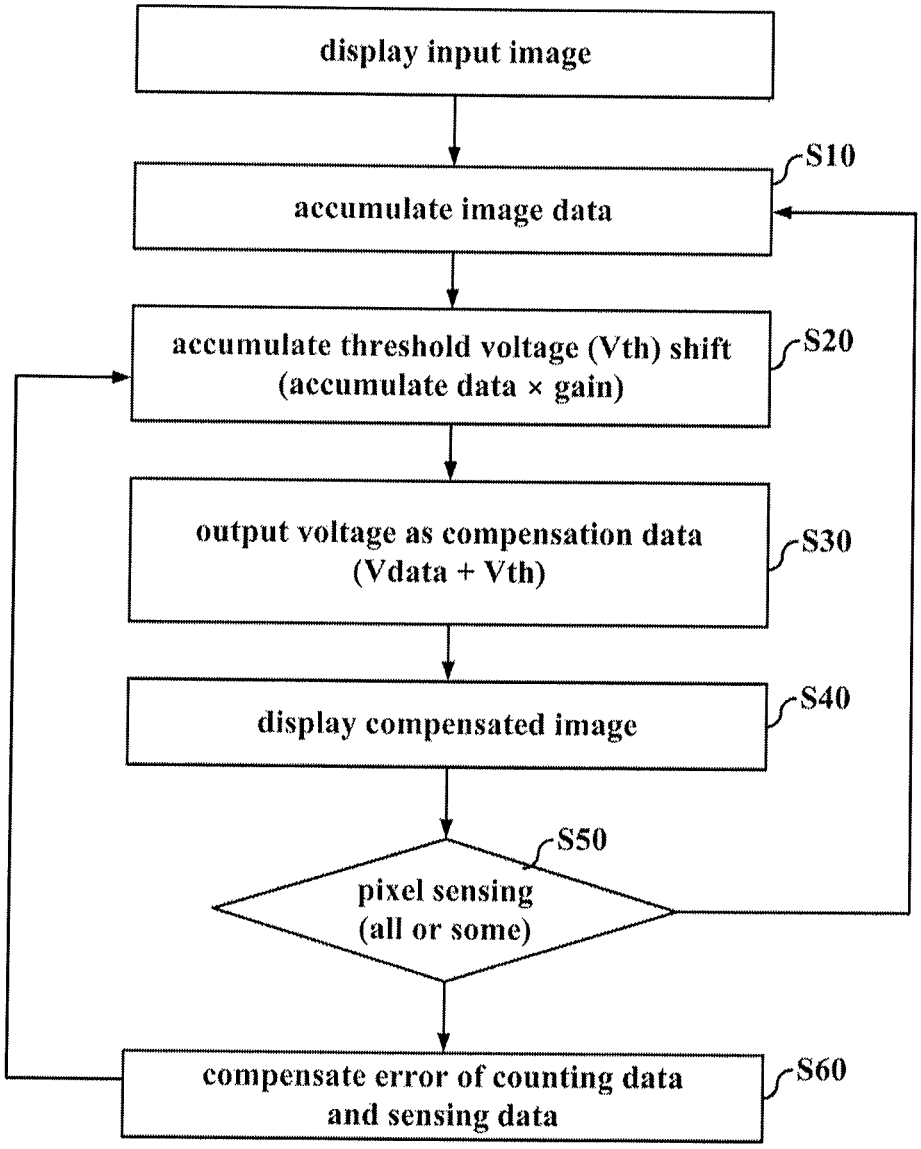
FIG. 7 illustrates a method of driving the organic light emitting display device according to the embodiment of the present invention.

FIG. 6 illustrates a timing controller of the organic light emitting display device according to the embodiment of the present invention. FIG. 7 illustrates a method of driving the organic light emitting display device according to the embodiment of the present invention.

In the organic light emitting display device of the present invention, a sensing value is compared with an estimated data degradation value, and then if an error of the two values is more than a reference value, a first gain (gain) applied to degradation compensation is controlled to generate a second gain (gain'). Also, the organic light emitting display device of the present invention is characterized in that degradation of the driving TFT is compensated by the use of second gain which is compensated. Accordingly, among the elements of the timing controller 400, an element for compensating degradation of the driving TFT will be described in detail, and the detailed description of the same element as the existing one will be omitted.

The timing controller 400 generates pixel data by compensating input data (Idata), which is externally input, based on accumulated data based on the data counting method and sensing data based on the sensing method, during the driving mode.

In this case, the compensation data stored in the memory 430 is loaded so that input data is compensated, wherein the compensation is performed for red pixels corresponding to one frame, and subsequently the compensation driving may be performed in the order of green pixel, blue pixel and white pixel.

For another example, when the input data is compensated, the compensation may be performed for the red pixel, the green pixel, the blue pixel and the white pixel, which correspond to one frame, at one time.

The pixel data generated by such a compensation driving is supplied to the data driver 200. The pixel data which will be supplied to the pixel P has a voltage level on which the compensation voltage for compensating threshold voltage/mobility of the driving TFD (DT) of the pixel P is reflected.

The input data (Idata) may include input data of red, green and blue, which will be supplied to one unit pixel. If the unit pixel includes a red pixel, a green pixel and a blue pixel, one pixel data may be data of red, green or blue.

On the other hand, if the unit pixel includes a red pixel, a green pixel, a blue pixel and a white pixel, one pixel data may be data of red, green blue or white.

Referring to FIG. 6 and FIG. 7, the timing controller 400 includes a data counter 410, a degradation estimating portion 420, a memory 430, a sensing controller 440, a comparator 450 and a degradation compensator 460.

The timing controller 400 operates each of the data driver 200 and the gate driver 300 in the driving mode based on a timing synchronizing signal (TSS) to display the input image.

For another example, the timing controller 400 operates the data driver 200 and the gate driver 300 in the sensing mode to sense the threshold voltage/mobility of the driving TFT (DT) at the time of setting of a user or reserved time.

In this case, the timing synchronizing signal (TSS) may be a vertical synchronizing signal (Vsync), a horizontal synchronizing signal (Hsync), a data enable (DE), a clock (DCLK), etc.

The timing controller 400 generates a data control signal (DCS) and a gate control signal (GCS) for sensing the threshold voltage/mobility of the driving TFT (DT) of each pixel (P) every one horizontal period based on the timing synchronizing signal (TSS) during the sensing mode. The timing controller 400 controls the data driver 200 and the gate driver 300 to be driven in the sensing mode by using the data control signal (DCS) and the gate control signal (GCS).

The gate control signal (GCS) for controlling the gate driver may include a gate start signal and a plurality of clock signals. The data control signal (DCS) for controlling the data driver may include a data start signal, a data shift signal, and a data output signal.

The timing controller 400 senses the threshold voltage/mobility of the driving TFT (DT) of each pixel (P) during the sensing mode by controlling the data driver 200 through the sensing controller 440. Afterwards, the timing controller 400 provides the sensing value of each pixel, which is obtained by sensing, to the comparator 450.

In this case, the sensing mode may be performed at the initial driving time of the display panel 100. Also, the sensing mode may be performed at the end time after the display panel 100 is driven for a long time. Also, the sensing mode may be performed in real time at a blank period of a frame, which displays an image, after the display panel is driven for a set time or certain time.

Figure 8:
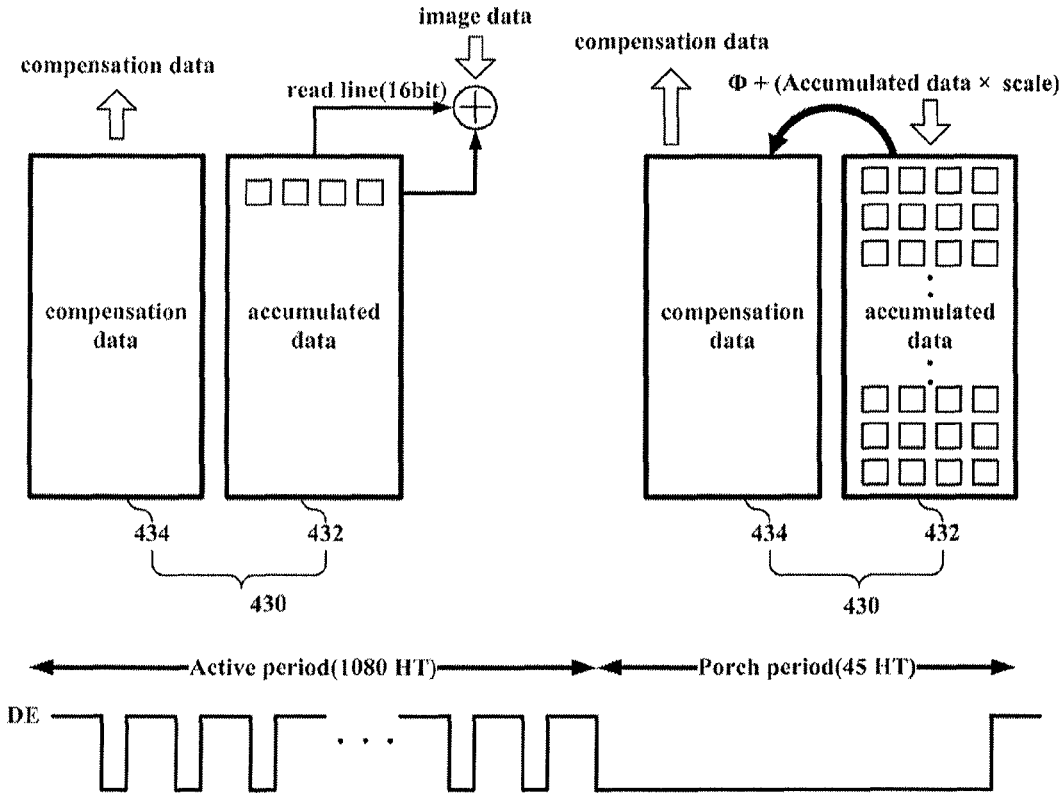
FIG. 8 illustrates a method of storing compensation data and accumulation data in a memory of the organic light emitting display device according to the embodiment of the present invention.

FIG. 8 illustrates a method of storing compensation data and accumulation data in the memory of the organic light emitting display device according to the embodiment of the present invention.

Hereinafter, the driving method of the organic light emitting display device according to the embodiment of the present invention and driving of the timing controller 400 will be described with reference to FIGS. 7 and 8.

Referring to FIGS. 7 and 8, the data counter 410 of the timing controller 400 performs data counting by using the estimated degradation data which is initially modeled. And, the data counter 410 of the timing controller 400 stores accumulated data of data counting in the memory 430 (S10). The data counter 410 stores the accumulated data in a first memory 432 by counting the data input for an active period of driving the display mode.

At this time, a read operation is performed for a 1 frame period, and a write operation is performed for a 1 frame period, whereby accumulated data of 1 frame may be stored in the first memory 432 for a total of 2 frames. A line memory may be used as the first memory 432.

The data counter 410 stores a shift value $\phi$ of the driving TFT and a sum of the accumulated data in the second memory 434 based on the accumulated data stored in the first memory 432 for a porch period between the (n) frame and (n+1) frame.

When the porch period is 40 to 50 horizontal periods (40~50 HT), the data counter 410 loads the data stored in the first memory 342 for initial 20 horizontal period (20 HT). The data counter 410 may store the data in the second memory 343 for the other 20 horizontal periods (20 HT). At this time, a frame memory may be used as the second memory 434.

Referring to FIG. 6, the degradation estimating portion 420 generates compensation data based on the shift value ϕ of the driving TFT and the sum of the accumulated data, which are stored in the second memory 434.

The degradation estimating portion 420 generates an estimated value of degradation of the driving TFT by using the shift value ϕ of the driving TFT and the sum of the accumulated data, which are stored in the second memory 434. At this time, the degradation estimating portion 420 generates the estimated value of degradation of the driving TFT by using a first gain set by initial modeling and the accumulated data (S20). The degradation estimating portion 420 provides the generated estimated value to the comparator 450 and the degradation compensator 460.

The degradation compensator 460 generates compensation data, on which the threshold voltage shift of the driving TFT is reflected, by the use of estimated degradation value of the driving TFT of the pixels based on the accumulated data. And, the degradation compensator 460 compensates the input data by using the generated compensation data, and supplies the compensated data to the data driver 200. The data driver 200 generates the data voltage based on the compensated data, and supplies the data voltage to each pixel (S30).

As described above, the shift of the threshold voltage of the driving TFT may be estimated using the accumulated data through data counting, and the input data may be compensated to supply the compensated data to all pixels of the display panel 100, whereby the compensated image may be displayed (S40).

The sensing controller 440 controls sensing of all the pixels at a certain time interval or set time. The sensing controller 440 provides the sensing value of the threshold voltage of the driving TFT of each pixel, which is obtained by sensing, to the comparator 450 (S50). At this time, the sensing controller 440 may sense all the pixels or some pixels only. The sensing value of each pixel, which is obtained by sensing, is reflected on the accumulated data.

For example, sensing data obtained by sensing driving from the first horizontal line to the last horizontal line (for example, $1080^{th}$ horizontal line) every one horizontal period (1 HT) may be reflected on the accumulated data. At this time, the sensing data is generated by sensing variations in the characteristics (shift level of threshold voltage) of the driving TFT of the pixels.

To this end, the timing controller 400 generates the sensing data set during the sensing mode, and supplies the generated sensing data to the data driver 200. The timing controller 400 senses the threshold voltage/mobility of the driving TFT (DT) of the pixels every one horizontal line for the blank period of the frame for displaying an image. The timing controller 400 performs this sensing for the plurality of frames, thereby sensing the threshold voltage/mobility of the driving TFT (DT) of all the pixels (P) of the display panel 100.

At this time, sensing of the pixel may be performed per color, wherein all the red pixels are sensed sequentially every one horizontal line, and then green pixels, blue pixels and white pixels are sensed sequentially every one horizontal line.

However, without limitation to the above example, all the pixels of the display panel 100 may be sensed to generate the sensing value, and deviation in the characteristics of the driving TFT of all the pixels may be compensated using the generated sensing value.

When the sensing data obtained by sensing together with the sensing driving is stored in the memory 430, the sensing data of the red pixels is first stored in the order of sensing, and then the sensing data of the green pixels, the blue pixels and the white pixels are sequentially stored in the memory 430. Afterwards, the sensing data of the red, green, blue and white pixels may be provided to the comparator 450.

In this case, all the pixels may be sensed for 10 seconds to 60 seconds in a state that no power is supplied to the display device. Also, all the pixels may be sensed for 10 seconds to 60 seconds at the end time after the display panel 100 is driven for a long time.

However, the characteristics of the driving TFT of all the pixels may be initiated using the initial compensation data stored in the initial compensation memory 500 without sensing all the pixels.

Also, all the pixels may be sensed for about 2 seconds at the initial driving time when the power is supplied to the display device. Also, after driving is performed for a previously set time or certain time period (for example, every one hour), all or some of the pixels may be sensed in real time for a blank time of a frame that displays an image. In the case that some pixels are only sensed, the sensing value obtained by sensing of some pixels may be applied to all the pixels.

The comparator 450 compares the estimated degradation value of the driving TFT of the pixels based on the accumulated data through data counting with the sensing value of the driving TFT of the pixels, which is obtained by sensing. Then, the comparator 450 provides the compared result to the degradation compensator 460.

Figure 9:
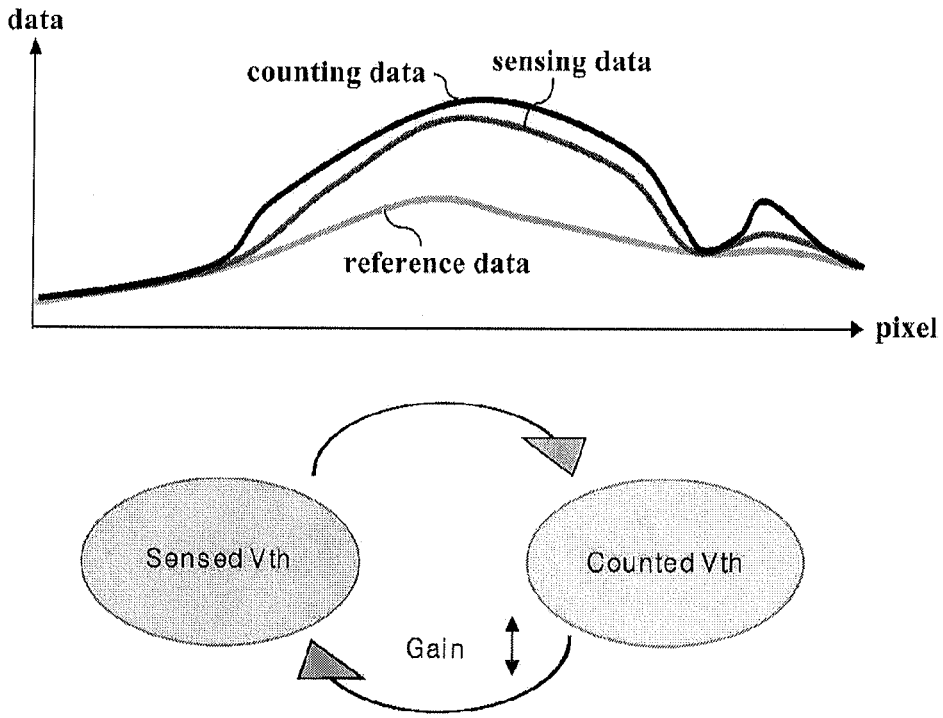
FIG. 9 illustrates a method of driving the organic light emitting display device according to the embodiment of the present invention, which relates to a method of compensating a degradation of driving TFT through combination of a data counting method and a sensing method.

FIG. 9 illustrates a method of driving the organic light emitting display device according to the embodiment of the present invention, which relates to a method of compensating a degradation of driving TFT through combination of a data counting method and a sensing method.

Referring to FIG. 9, if an error between the estimated degradation value of the driving TFT of the pixels and the sensing value of the driving TFT of the pixels, which is obtained by sensing, is less than a reference value (for example, less than 2%), the comparator 450 provides the compared results of the two values to the degradation compensator 460, whereby the degradation compensator 460 may use the first gain value as it is.

If the error between the two values is less than the reference value, for example, if the difference between the two values is less than 2%, the degradation compensator 460 compensates all the pixels by using the first gain set based on initial modeling.

For another example, after display driving of the image is performed for a certain time, the estimated degradation value of the driving TFT based on the accumulated data through data counting is compared with the sensing value obtained by the aforementioned sensing driving, whereby the first gain, which is initially set, may be controlled.

If the error between the estimated degradation value of the driving TFT of the pixels based on the accumulated data and the sensing value of the driving TFT of the pixels, which is obtained by sensing, is more than the reference value (for example, the difference between the two values is more than 2%), the comparator 450 controls the first gain to the second gain (gain') by using the sensing value.

The comparator 450 provides the controlled second gain (gain') to the degradation compensator 460. The degradation compensator 460 compensates the error of the accumulated data based on data counting by using the controlled second gain (gain'), and compensates degradation of the driving TFT of all the pixels (S60).

In this case, the second gain (gain') may be generated through the following Equation 1.

$$\text{Second gain(Gain')}=\text{first gain(Gain)}*(\text{Sensed_}Vth/\text{Counted_}Vth) \quad \text{Equation 1}$$

In the above Equation 1, the estimated degradation value (Counted_Vth) of the driving TFT based on the accumulated data is the value (Counted_Vth=Counting Data−Ref Data) obtained by subtracting the reference voltage (initial Vth value) from the accumulated data value.

The sensing value (Sensed_Vth) is the value (Sensed_Vth=Sensing Data−Ref Data) obtained by subtracting the reference voltage (initial Vth value) from the sensing data based on sensing driving.

The value obtained by dividing the sensing value (sensed_Vth) by the accumulated data value (counted_Vth) may be multiplied by the first gain to generate the second gain (gain').

This error of the accumulated data of the data counting method may be compensated by the sensing value of the threshold voltage/mobility to generate compensation data, whereby performance of external compensation may be improved, and picture quality may be prevented from being deteriorated by the data counting method.

The organic light emitting display device and the method of driving the same according to the embodiment of the present invention have the following advantages.

The error of the compensation data based on the accumulated data may be reduced using the accumulated data through data counting and the sensing value based on sensing of the pixels.

Also, since the error of the accumulated data of the data counting method is compensated by the sensing value of the threshold voltage/mobility to generate the compensation data, performance of external compensation may be improved, and picture quality may be prevented from being deteriorated by the data counting method.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of driving an organic light emitting display device comprising:

generating a first gain value, which is initially set;

after the first gain value is obtained, generating an estimated degradation value of a driving TFT by using accumulated data through input data counting, a sum of the accumulated data being stored in a first memory by counting the input data, and the sum of the accumulated data and a shift value of the driving TFT being stored in a second memory for a porch period between (n) frame and (n+1) frame;

compensating all the pixels of a display panel by using the first gain value, and the estimated degradation value;

generating a sensing value by sensing all or some of the pixels of the display panel after driving is performed for a certain time;

comparing the sensing value with the estimated degradation value;

generating a second gain value by compensating the first gain value if an error between the estimated degradation value and the sensing value is more than a reference value;

generating compensation data by compensating the estimated degradation value by using the second gain value; and compensating all the pixels of the display panel by using the compensation data.

2. The method of claim 1, wherein the pixels are sensed at the initial driving time when a power is supplied to the display panel, at the end time after the display panel is driven for a long time, or in real time at a blank period of a frame after the display panel is driven for a set time or certain time.

3. The method of claim 1, wherein the pixels are compensated using the first gain if the error between the estimated degradation value and the sensing value is less than 2%.

4. The method of claim 1, wherein the pixels are compensated using the second gain if the error between the estimated degradation value and the sensing value is more than 2%.

5. The method of claim 4, wherein an error of the accumulated data through data counting is compensated using the second gain, and degradation of the driving TFT of the pixels is compensated.

6. The method of claim 1, wherein the second gain is generated using the following Equation, Equation: Second gain (Gain')=first gain (Gain)*(Sensed_Vth/Counted_Vth), where 'Counted_Vth' is the estimated degradation value of the driving TFT based on the accumulated data, and 'Sensed_Vth' is the sensing value of the pixels through sensing driving.

7. The method of claim 1, wherein a deviation in characteristics of the driving TFT of all the pixels is compensated using the sensing value generated by sensing of all the pixels of the display panel.

8. An organic light emitting display device comprising:

a display panel on which a plurality of pixels are arranged;

a gate driver that supplies a scan signal and a sensing signal to the plurality of pixels;

a data driver that supplies a compensated data voltage to the plurality of pixels and sensing characteristics of the plurality of pixels; and a timing controller that drives the gate driver and the data driver in a driving mode and a sensing mode, and generates compensation data by using an estimated degradation value of a driving TFT based on accumulated data through input data counting and a sensing value obtained by sensing of the plurality of pixels and based on a comparison between the estimated degradation value and the sensing value, wherein the timing controller includes, a data counter that stores accumulated data in a first memory by counting input data, and stores a sum of the accumulated data stored in the first memory and a shift value of the driving TFT in a second memory for a porch period between (n) frame and (n+1) frame, and a degradation estimating portion that generates an estimated degradation value of the driving TFT by using the sum of the accumulated data and the shift value of the driving TFT.

9. The organic light emitting display device of claim 8, wherein the timing controller further includes:

a sensing controller that generates a sensing value by sensing all or some of the pixels of the display panel after driving is performed for a certain time;

a comparator that compares the estimated degradation value with the sensing value, and generating a second gain value by compensating a first gain value if an error of the compared result is more than a reference value; and a degradation compensator that generates compensation data by using the first gain value, which is initially set, and the estimated degradation value if the error is less than the reference value, and generating compensation data by using the second gain value if the error is more than the reference value.

10. The organic light emitting display device of claim 9, wherein the timing controller senses a threshold voltage/mobility of the driving TFT of the plurality of pixels every one horizontal line for a blank period of a frame, which displays an image, by driving the data driver in a sensing mode.

11. The organic light emitting display device of claim 10, wherein the pixels are sensed at the initial driving time when a power is supplied to the display panel, at the end time after the display panel is driven for a long time, or in real time at a blank period of a frame after the display panel is driven for a set time or certain time.

* * * * *